US005362248A

United States Patent [19]

Hashiguchi et al.

[11] Patent Number: 5,362,248

[45] Date of Patent: Nov. 8, 1994

[54] CONNECTOR CAPABLE OF AUTOMATICALLY AND RELIABLY INHIBITING DISENGAGEMENT OF MEHANICAL COUPLING BETWEEN CONNECTION MEMBERS

[75] Inventors: Osamu Hashiguchi; Minoru Shinmyo, both of Tokyo, Japan

[73] Assignee: Japan Aviation Electronics Industry, Ltd., Japan

[21] Appl. No.: 11,295

[22] Filed: Jan. 29, 1993

[30] Foreign Application Priority Data

Feb. 3, 1992 [JP] Japan ..... 4-3461[U]
Jun. 24, 1992 [JP] Japan ..... 4-43852[U]

[51] Int. Cl.[5] ..... H01R 13/627
[52] U.S. Cl. ..... 439/352; 439/350
[58] Field of Search ..... 439/350, 352, 353, 354, 439/355, 357, 358

[56] References Cited

U.S. PATENT DOCUMENTS 4,548,455 10/1985 Ezure ..... 439/352
4,954,097 9/1990 Sekiguchi ..... 439/352
5,082,455 1/1992 Wei ..... 439/352
5,096,436 3/1992 Noschese ..... 439/352
5,195,905 3/1993 Pesci ..... 439/352
5,197,895 3/1993 Stupecky ..... 439/352

*Primary Examiner*—Larry I. Schwartz
*Assistant Examiner*—Hien D. Vu
*Attorney, Agent, or Firm*—Laff, Whitesel, Conte & Saret

[57] ABSTRACT

For mechanically coupling a pin connector (10) with a socket connector (11) in a predetermined direction in accordance with a predetermined operation, a connector comprises a recessed portion (22) on the socket connector, a flexible arm (16) connected to the pin connector, an engaging projection (16*a*) connected to the flexible arm, and a movable member (20) movably mounted on the socket connector. The engaging projection is for making a predetermined engagement with the recessed portion in the predetermined direction and is disengaged from the recessed portion only with bending of the flexible arm. The movable member automatically inhibits the flexible arm from bending thereof after the predetermined engagement is obtained. It is preferable that the pin connector is automatically disconnected from the socket connector when the predetermined engagement is not obtained in spite of the predetermined operation.

8 Claims, 8 Drawing Sheets

CONNECTOR CAPABLE OF AUTOMATICALLY AND RELIABLY INHIBITING DISENGAGEMENT OF MEHANICAL COUPLING BETWEEN CONNECTION MEMBERS

BACKGROUND OF THE INVENTION

This invention relates to a connector which is for use in an electric system and the like and which includes connection members adapted to be connected to each other and, in particular, to a connector of the type described wherein the connection members are mechanically coupled after a predetermined connection is obtained between the connection members.

A conventional connector of the type described generally comprises a mechanical coupling arrangement for stably maintaining a predetermined connection between first and second connection members. As will later be described with reference to the drawings, the mechanical coupling arrangement includes an engaging portion and a locking member. The engaging member is fixedly attached to the first connection member. The looking member is movably attached to the second connection member. After the predetermined connection is made between the first and the second connection members, the looking member is manually operated to be engaged with the engaging portion. Thus, a mechanical coupling is obtained between the first and the second connection members.

With the mechanical coupling arrangement of the conventional connector, however, it is necessary to manually operate the locking member in a connecting operation which completes the mechanical coupling. This results in a reduced efficiency in the connecting operation.

In addition, the mechanical coupling arrangement is disadvantageous in that it is difficult to judge whether or not the first and the second connection members are completely connected. In a case where the predetermined connection is incomplete, an automobile might suffer an interruption in an electric system due to an unanticipated disconnection between the first and the second connection members.

SUMMARY OF THE INVENTION

It is an object of this invention to provide a connector which achieves an excellent efficiency in a connecting operation and which assures and maintains a complete connection between first and second connection members.

According to this invention, there is provided a connector comprising a first connection member, a second connection member adapted to make a predetermined connection with the first connection member in a predetermined direction, and mechanical coupling means for mechanically coupling the first connection member with the second connection member in the predetermined direction. The first connection member has a principal surface which is extended in the predetermined direction. The mechanical coupling means comprises a first engaging portion connected to the principal surface of the first connection member, a flexible arm connected to the second connection member and extending in parallel to the principal surface in the predetermined direction when the first connection member is connected to the second connection member. The flexible arm is flexible in a particular plane perpendicular to the principal surface. The mechanical coupling means further comprises a second engaging portion connected to the flexible arm for making a predetermined engagement with the first engaging portion in accordance with the predetermined connection. The second engaging portion is disengaged from the first engaging portion only with said flexible arm bent in the particular plane. The mechanical coupling means further comprises disengagement inhibiting means connected to the first connection member for detecting the predetermined engagement in order to inhibit the flexible arm from bending thereof after detection of the predetermined engagement.

DESCRIPTION OF THE PREFERRED EMBODIMENTS

Figure 1:
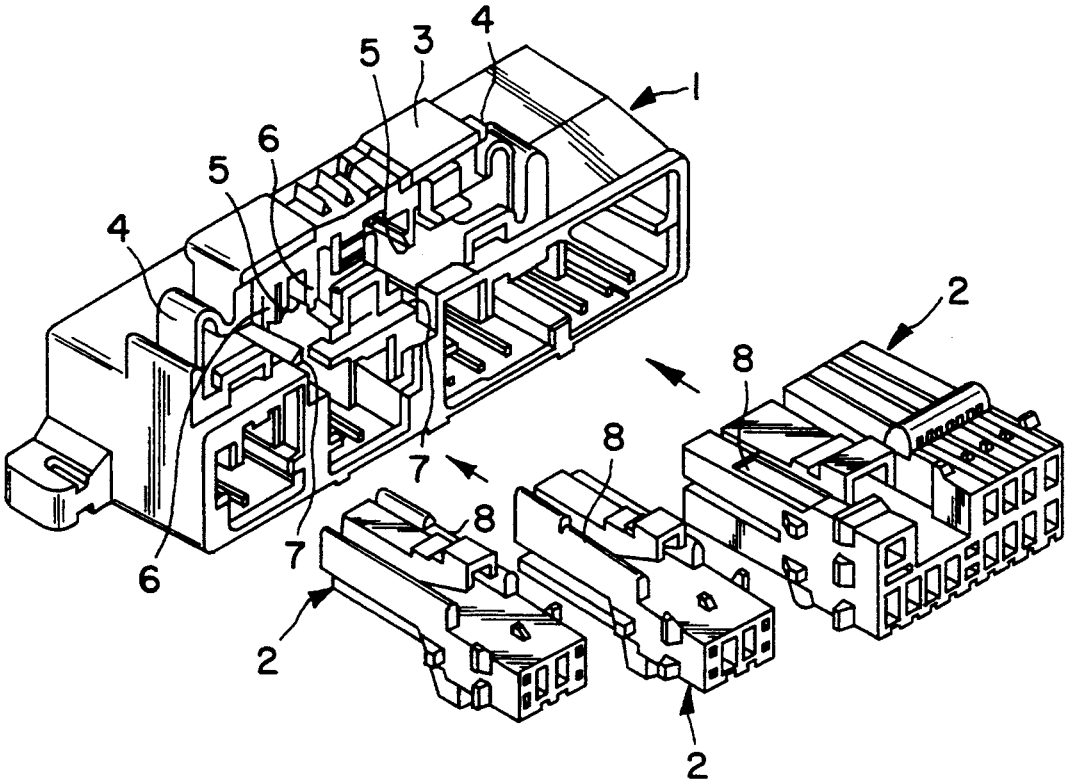
FIG. 1 PRIOR ART
FIG. 1 is a perspective view of a conventional connector.

Referring to FIG. 1, a conventional connector will at first be described for a better understanding of this invention. The conventional connector comprises a pin connector 1 and a plurality of socket connectors 2. Each of the socket connectors 2 is coupled or inserted into the pin connector 1 by sliding in a predetermined direction to thereby provide a predetermined electrical connection in an electric system of an automobile. The connector further comprises a mechanical coupling arrangement for maintaining a mechanical coupling between the pin connector 1 and each of the socket connectors 2.

The pin connector 1 has support bands 4 and locking members 3. Each of the support bands 4 is attached to an upper end of the pin connector 1. Each of the locking members 3 is supported by each of the support bands 4 to be movable in a vertical direction.

An engaging piece 5 and a projecting portion 6 are formed at the bottom of each locking member 3. A counterpart engaging piece 7 is formed below each locking member 3 to engage the engaging piece 5 when the locking member 3 is displaced downwardly. Thus, the pin connector 1 has a locking arrangement which is formed by a combination of each of the locking members 3, each of the support bands 4, each of the engaging pieces 5, each of the projecting portions 6, and each of the counterpart engaging pieces 7. For brevity of description, one each component alone will be described herein, although a plurality of the similar components are shown in the figures.

The socket connector 2 has a recess 8 which is formed to receive the projecting portion 6 of the locking member 3 when the socket connector 2 is completely coupled with the pin connector 1. The recess 8 thus forms a locking arrangement of the socket connector 2.

Figure 2:
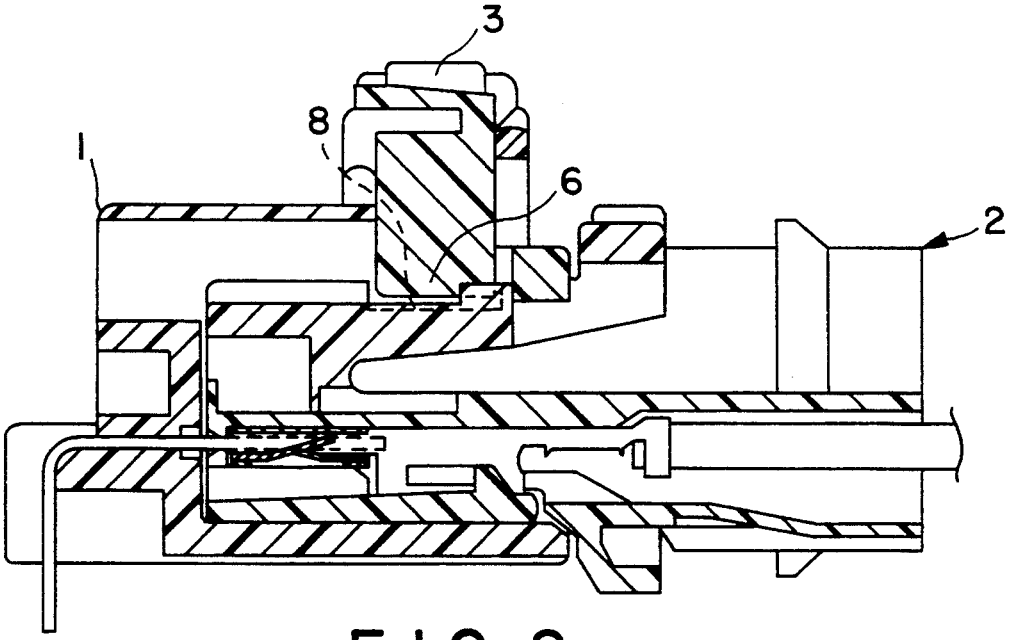
FIG. 2 PRIOR ART
FIG. 2 is a longitudinal sectional view of the conventional connector illustrated in FIG. 1 in a completed connection.

After the socket connector 2 is inserted into the pin connector 1, the locking member 3 is manually pushed downwardly as illustrated in FIG. 2. In this event, the engaging piece 5 is engaged with the counterpart engaging piece 7 while the projecting portion 6 is received in the recess 8. Thus, the socket connector 2 is prevented from being accidently decoupled from the pin connector 1. Accordingly, a combination of these locking arrangements of the pin connector 1 and the socket connector 2 is referred to as a "mechanical coupling arrangement".

In the above-mentioned mechanical coupling arrangement, it is necessary to manually push the locking member 3 downwardly in order to obtain the mechanical coupling. Accordingly, a connecting operation is troublesome. When the locking member 3 is pushed down, the support band 4 is subjected to a stress in the manner known in the art.

Figure 3:
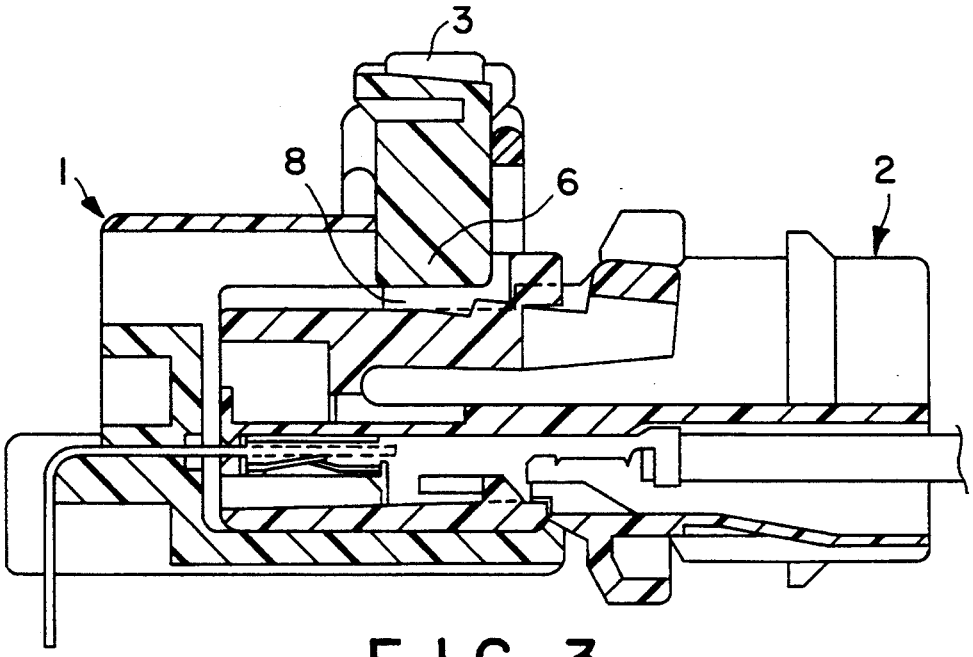
FIG. 3 PRIOR ART
FIG. 3 is a longitudinal sectional view of the conventional connector illustrated in FIG. 1 in incomplete connection.

In addition, the projecting portion 6 and the recess 8 are located in the interior of the pin connector 1 when the projecting portion 6 is received in the recess 8. Accordingly, it is impossible to visually confirm whether or not the mechanical coupling is completely carried out. It is also impossible to accurately judge a state of the connection by a displacement of the locking member 3 on the pin connector 1. In view of the above described short comings of the prior art, an examination must be made to confirm that the connection has been completed, the examination being made after coupling the pin connector 1 and the socket connector 2. In a case where the pin connector 1 and the socket connector 2 are readily releasably assembled in a manufacturing process and are equipped in an automobile with an incomplete connection as illustrated in FIG. 3, a disconnection might possibly occur during use of the automobile. Such a disconnection would cause an interruption of the electric system.

Figure 4:
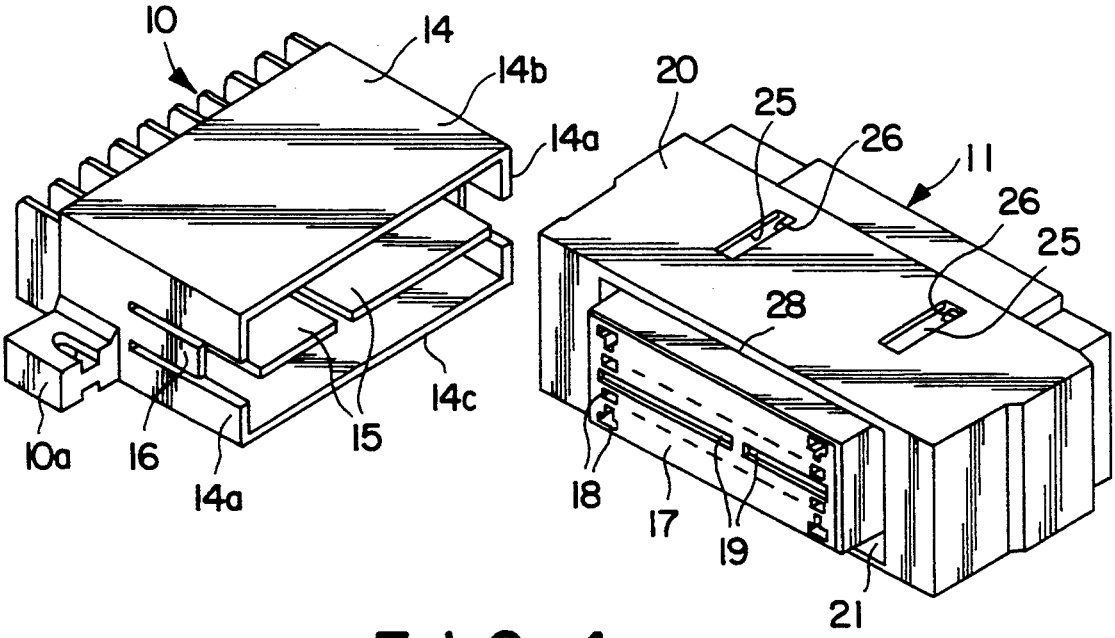
FIG. 4 is a perspective view of a connector according to a first embodiment of this invention.
Figure 5A:
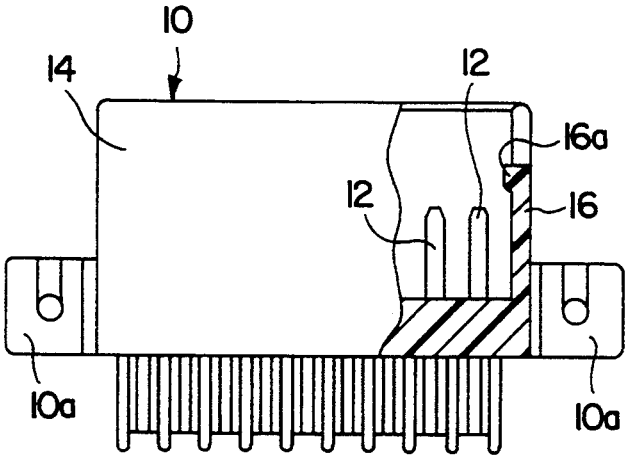
FIG. 5(A) is a plan view of a pin connector included in the connector illustrated in FIG. 4, the pin connector having a part cut off.
Figure 5B:
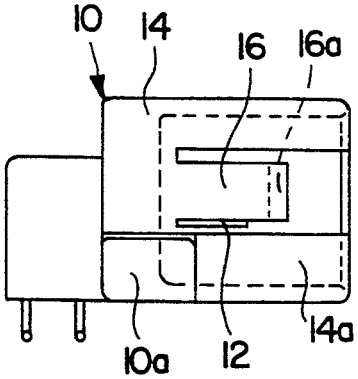
FIG. 5(B) is a side view of the pin connector illustrated in FIG. 5(A)
Figure 6A:
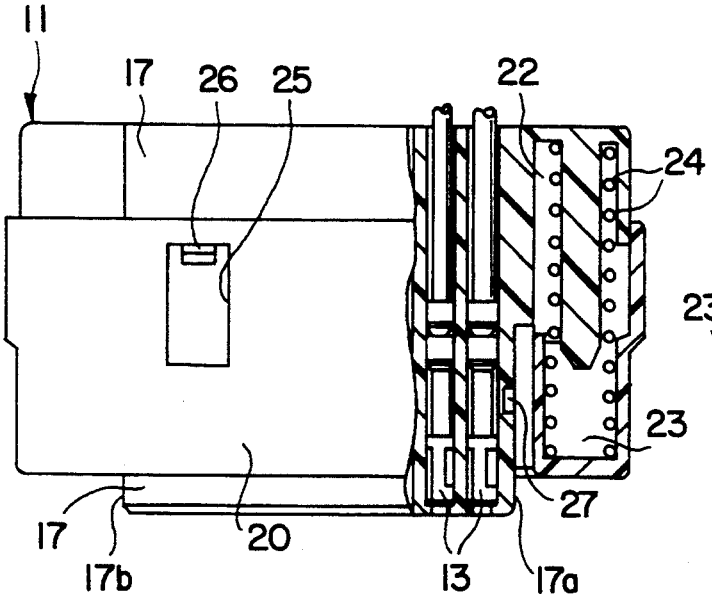
FIG. 6(A) is a plan view of a socket connector included in the connector illustrated in FIG. 4, the socket connector having a part cut off.
Figure 6B:
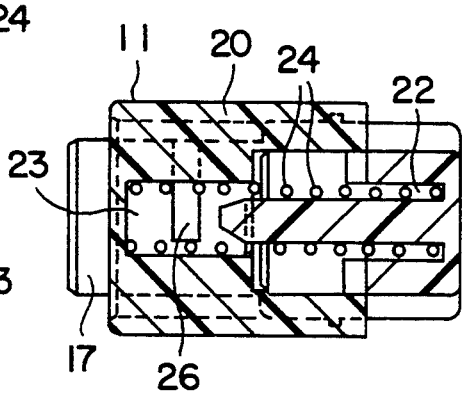
FIG. 6(B) is a side view of the socket connector illustrated in FIG. 6(A)

Referring to FIGS. 4 through 6, the description will proceed to a connector according to a first embodiment of this invention. The connector comprises a pin connector 10 and a socket connector 11, which is referred to as a "first connection member or element". Connector is adapted to make the predetermined electrical connection with the pin connector 10 by sliding in the coupling direction. The pin connector 10 is referred to as a "second connection member or element".

The pin connector 10 comprises a box housing 14 having an open end at a front side or a coupling side. The housing 14 has opposite side plates **14*a* each of which is provided with a mounting flange 10*a*. In the housing 14, a guide plate 15 is centrally formed to divide the interior of the housing 14 into an upper part and a lower part. The guide plate 15 is provided for guiding the socket connector 11** in a coupling operation which is for making the predetermined electrical connection.

A plurality of pin contacts 12 (FIG. 5) are arranged in the housing 14 the pins extending from the rear side towards the front side in parallel with a predetermined direction in which the connectors slide in order to complete a connection or a coupling direction. A notch is made at the center of each side plate **14*a* of the housing 14. In each notch, a flexible arm or an engaging piece 16 is integrally formed with each side plate 14*a*. The arm extends in a forward direction of the coupling direction. Each engaging piece 16 has a top end located in the notch, inwardly from a forward edge of the side plate 14*a*. Each engaging piece 16 has a flexibility such that the engaging piece 16 can be slightly bent in an outward direction. An engaging projection 16*a* is formed at the free end of each engaging piece 16** to project in an inward direction, perpendicular to the coupling direction.

The socket connector 11 comprises a box housing 17 and is adapted to be coupled with the pin connector 10 in the coupling direction. A plurality of socket contacts 13 are arranged in the housing 17 and extend from the front side towards the rear side in parallel to the coupling direction. The housing 17 has a size such that the housing 17 can be coupled in an opening of the housing 14 of the pin connector 10. The housing 17 has, at its front side, a plurality of pin holes 18 for insertion of the pin contacts 12 and a slot 19 for insertion of the guide plate 15. The housing 17 is covered by a movable cover 20 except for the front and the rear sides of the housing 17. The movable cover 20 is backwardly and forwardly movable along the coupling direction. On the front side of the movable cover 20, an opening portion 21 is formed for an insertion of the pin connector 10. The opening portion 21 has a size such that the side plates **14*a*, a top plate 14*b*, and a bottom plate 14*c* of the housing 14 of the pin connector 10 can be inserted in the opening portion 21. The free ends of the engaging pieces 16 are engaged with an opening edge 28 of the movable cover 20** with a progressive insertion.

Spring containing spaces 22 are in the left and the right side portions of the housing 17. Likewise, spring containing spaces 23 are in the left and the right side portions of the movable cover 20. In each side, the spring containing spaces 22 and 23 face to each other, in the predetermined direction. A spring 24 is arranged in the spring containing spaces 22 and 23 in each side portion spring 24 extends in the coupling direction. By those two springs 24, one in each side, the movable cover 20 is constantly urged in a forward direction of the coupling direction. However, the movable cover 20 is held by engagement between elongated apertures 25 made on the top of the movable cover 20 and projections 26 formed on the top of the housing 17.

The housing 17 has left and right side surfaces **17*a* and 17*b* each of which is referred to as a "principal surface". On the left and the right side surfaces 17*a*** and 17*b*, engaging recessed portions or grooves 27 are formed as counterpart engaging portions which are to be engaged with the engaging projections 16*a* of the engaging pieces 16 only in a case where the pin connector 10 and the socket connector 14 are completely coupled and connected. The engaging grooves 27 are normally concealed by the movable cover 20 and are uncovered when the movable cover 20 is moved or displaced. The projections 26 of the housing 17 are received in the elongated apertures 25 of the movable cover 20. Therefore, the movable cover 20 can be moved within a range corresponding to the movement of the projections 26 within the elongated apertures 25. In other words, the movable cover 20 is movable between a first and a second position of the predetermined direction.

In the connector having the above-mentioned structure, a locking arrangement of the pin connector 10 comprises the engaging pieces 16 formed on the housing 14, including the engaging projections 16*a*. On the other hand, a locking arrangement of the socket connector 11 comprises a combination of the engaging grooves 27 formed on the left and the right sides of the housing 17, the projections 26 formed on the top of the housing 17, the opening edge 28 of the movable cover 20 covering the housing 17, the elongated apertures 25 formed on the top of the movable cover 20, the springs 24 arranged in the spring containing spaces 22 and 23 formed in the left and the right sides of the housing 17 and the movable cover 20. A combination of the locking arrangements of the pin connector 10 and the socket connector 11 is referred to as a "mechanical coupling arrangement".

Herein, the movable cover 20 faces the principal surface of the socket connector 11 with a predetermined space left therebetween when the movable cover 20 is at least at the second position. The predetermined space has a first width in the coupling direction. Each of the engaging pieces 16 has a second width which is smaller than the first width in a particular direction perpendicular to the principal surface of the socket connector 11 when the pin connector 10 is connected to the socket connector 11. Each of the engaging projections 16 has a third width in the predetermined direction. The first width is smaller than a sum of the second and the third widths.

Next referring to FIGS. 7 and 8, a connection process of the connector will be described step by step.

Figure 7A:
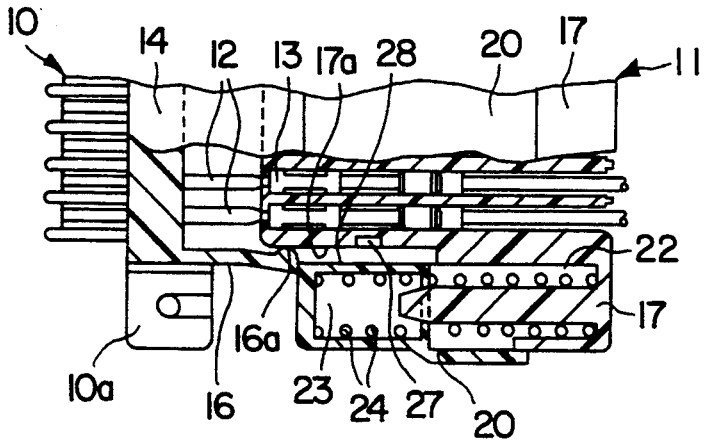
FIGS. 7(A), (B), and (C) are sectional views for describing a step by step connection process for the connector illustrated in FIG. 4, FIGS. 7(A), (B), and (C) showing an initial stage, an intermediate stage, and a last stage, respectively of the connection.
Figure 7B:
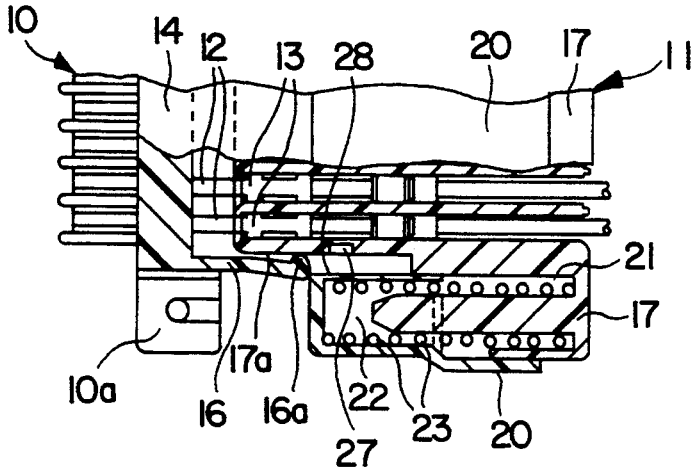
Figure 8A:
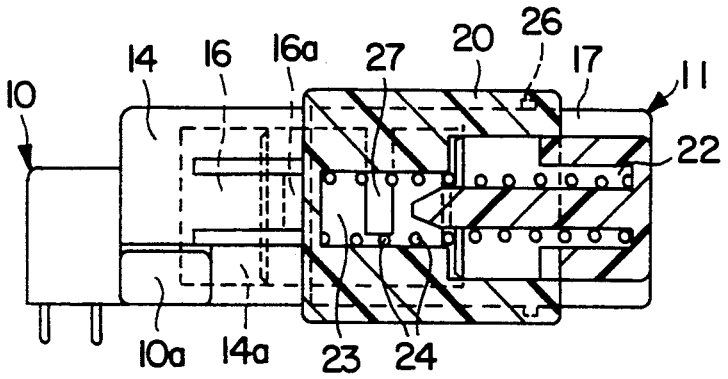
FIGS. 8(A), (B), and (C) are side views for describing the step by step connection process of the connector illustrated in FIG. 4, FIGS. 8(A), (B), and (C) showing an initial stage, an intermediate stage, and a last stage, respectively.
Figure 8B:
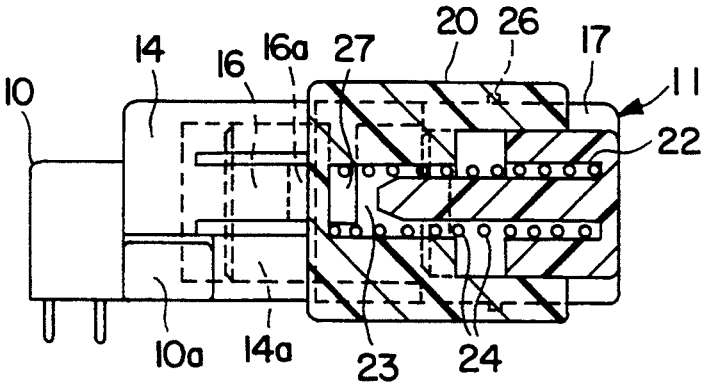

In an initial stage, an insertion of the socket connector 11 into the pin connector 10 is started. As illustrated in FIGS. 7(A) and 8(A), the engaging projections 16*a* of the engaging pieces 16 are brought into contact with the forward edge of the housing 17. The engaging pieces 16 are forced to be outwardly bent so that the engaging projections 16*a* are brought in to a press contact with the side surfaces 17*a* and 17*b* of the housing 17, respectively. When the insertion further proceeds, the top ends of the engaging pieces 16 collide with the opening edge 28 of the movable cover 20 and are kept in engagement therewith, as illustrated in FIGS. 7(B) and 8(B). With the progress of the insertion, the movable cover 20 is forced by the engaging projections 16*a* to be moved rearwardly relative to the housing 17 of the socket contact 11. The springs 24 are compressed by the relative movement between the movable cover 20 and the housing 17. In this state, the flexibility of the engaging pieces 16 serves as a first displacement means for moving the movable cover 20 in a rearward direction relative to the predetermined direction to the first position. At this time, the projections 26 are moved within the elongated apertures 25. During the above-mentioned process, the pin contacts 12 are inserted into and connected with the socket contacts 13 in one-to-one correspondence.

Figure 7C:
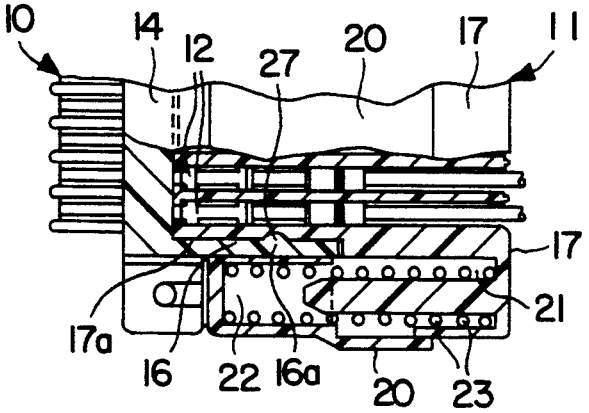
Figure 8C:
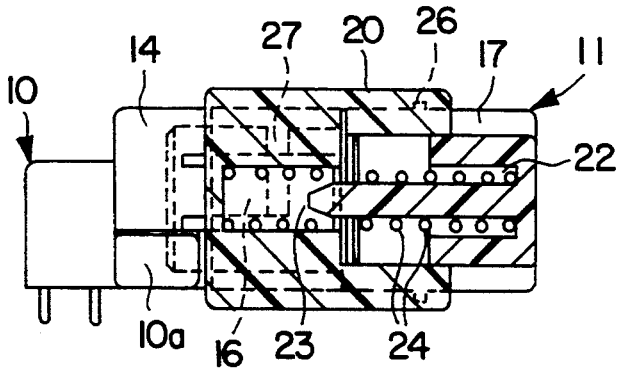

The housing 17 is further inserted in the housing 14 until the pin connector 10 and the socket connector 11 are completely coupled, as illustrated in FIGS. 7(C) and 8(C). With the rearward movement of the movable cover 20, the engaging grooves 27 are uncovered. Accordingly, the engaging projections 16*a* of the engaging pieces 16 are engaged with the engaging grooves 27. In this state, the engaging pieces 16 are elastically recovered from a bending state into an original or straight shape. As a result, the top ends of the engaging pieces 16 and the opening edge 28 of the movable cover 20 are released from engagement with each other.

In this state, the flexibility of the engaging pieces 16 serves as disengagement means for releasing the engagement between the movable cover 20 and the top ends of the engaging pieces 16*a*. The movable cover 20 is urged by the spring 24 to move in the forward direction. After covering the engaging pieces 16 and the side plates 14*a* of the housing 14, the movable cover 20 is returned back to its initial position where the projections 26 are engaged with the backward ends of the elongated holes 25.

Thus, the socket connector 11 is completely coupled and connected with the pin connector 10. Since the engaging pieces 16 are covered by the movable cover 20, the engaging projections 16*a* can not be released from the engaging grooves 27. It is thus possible to inhibit disengagement due to an external force. Accordingly, a complete coupling and connection can be achieved and maintained.

Consideration will now be made as regards a case where complete coupling is not achieved. In the intermediate stage illustrated in FIGS. 7(B) and 8(B), the top ends of the engaging pieces 16 are brought into contact with the opening edge 28 of the movable cover 20 while the springs 24 are compressed. In this case, it is assumed that the engaging projections 16*a* of the engaging pieces 16 do not reach the engaging grooves 27 due to insufficient insertion. Since the movable cover 20 is urged by the springs 24 and, in turn, urges the engaging pieces 16 in the forward direction, the pin connector 10 and the socket connector 11 are separated from each other and they can not be coupled at all. Thus, upon the coupling operation, the connector according to this invention can only be put into either a complete coupling or a complete separation between the pin connector 10 and the socket connector 11.

In order to disconnect the pin connector 10 and the socket connector 11, the movable cover 20 is retracted in the rearward direction while the springs 24 are compressed. With retraction of the movable cover 20, the engaging projections 16*a* of the engaging pieces 16 are uncovered and removed from the engaging grooves 27. Since the movable cover 20 is urged by the springs 24 and in turn urges the engaging pieces 16, the pin connector 10 and the socket connector 11 are readily separated from each other.

Figure 9:
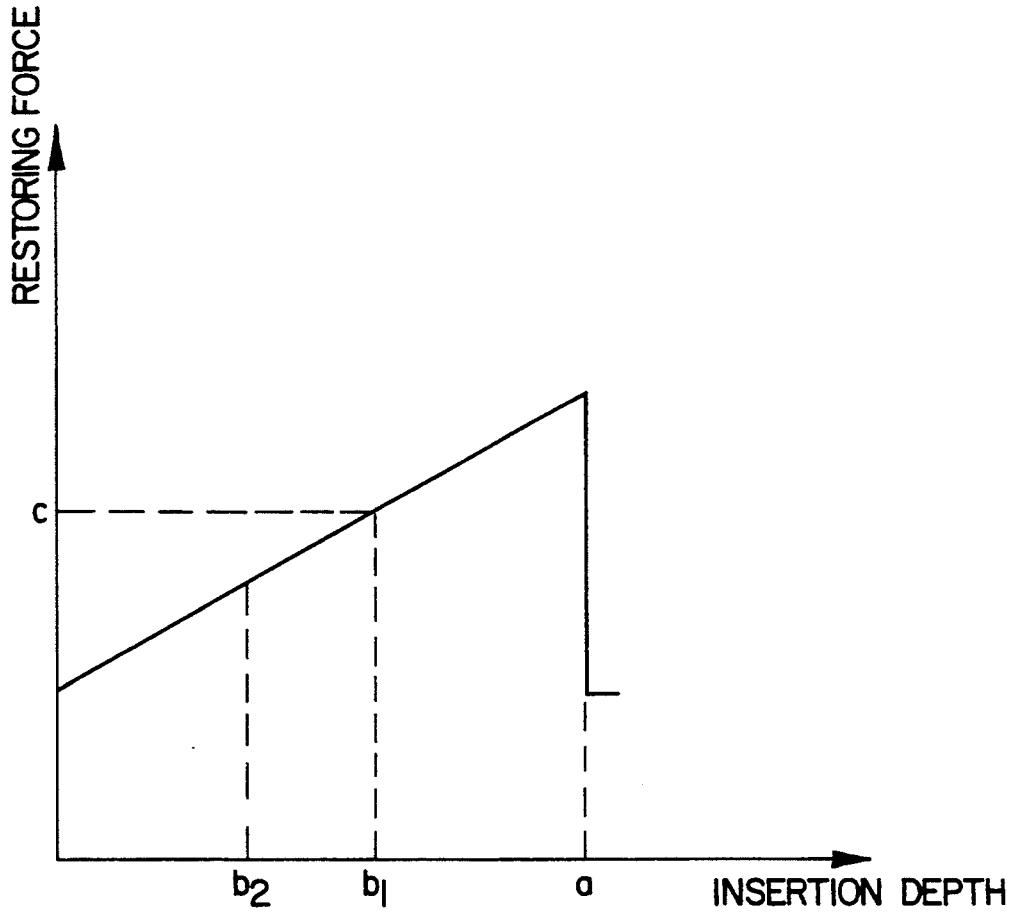
FIG. 9 is a graph showing a relationship between an insertion depth and a restoring force of a spring used in the connector illustrated in FIG. 4.

The spring 24 has an urging force (restoring force) which is determined in accordance with restoring force characteristic as illustrated in FIG. 9. The pin and the socket connectors 10 and 11 have an insertion depth which varies in accordance with the coupling operation. In FIG. 9, an abscissa and an ordinate represent the insertion depth and the restoring force, respectively. The insertion depth a represents a condition in which the predetermined electrical connection is obtained. The insertion depth b1 represents a condition in which a contact is completely obtained between each of the pin contacts 12 and each of the socket contacts 13. The insertion depth b2 represents a condition in which the contact is started between each of the pin contacts 12 and each of the socket contacts 13. The restoring force c of the spring 24 is in balance at the insertion depth b1.

The restoring force c of the springs 24 is selected so that the restoring force c is greater than a removal force d. The removal force d is defined as a force which is required to remove the pin connector 10 when each of the pin contacts 12 and each of the socket contacts 13 are brought into complete contact at the insertion depth b2. Specifically, the urging force c must be selected so that neither mechanical coupling nor electric connection can be achieved unless a complete coupling, (namely, the predetermined electrical connection) is assured by an engagement between the engaging projections 16*a* of the pin connector 10 and the engaging grooves 27 of the socket connector 11, even if each of the pin contacts 12 and each of the socket contacts 13 are put in the complete contact.

According to this embodiment, the coupling operation between the pin connector 10 and the socket connector 11 results in either the complete coupling or complete separation. In other words, an incomplete coupling can not occur. As compared with the conventional locking member, durability is remarkably improved against repetitive use because no support band of a reduced thickness is required. Furthermore, it is unnecessary to manually operate the locking arrangement. This results in improvement of efficiency in a coupling operation.

Figure 10:
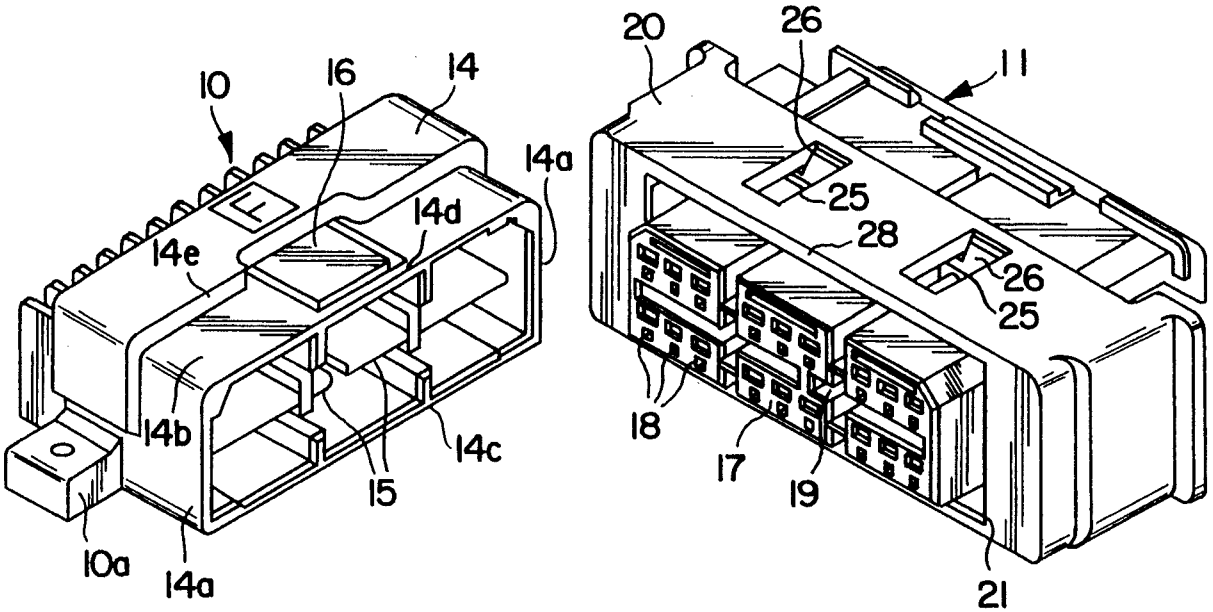
FIG. 10 is a perspective view of a connector according to a second embodiment of this invention.
Figure 11:
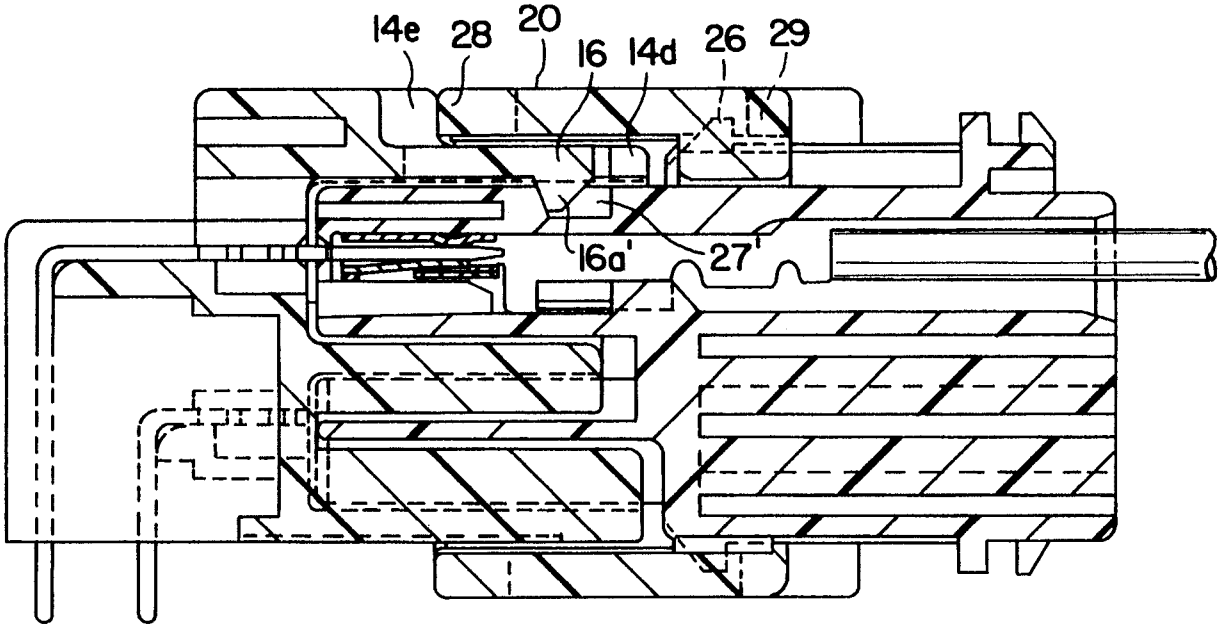
FIG. 11 is a longitudinal sectional view of the connector illustrated in FIG. 10 in complete connection.

Now referring to FIGS. 10 and 11, a connector having a locking arrangement according to a second embodiment of this invention will be described. Similar parts are designated by like reference numerals and will not be described any longer.

In the second embodiment, the housing 14 is provided with a step portion 14*e* having a higher level and a lower level. The lower level comprises the top plate 14*b* of the housing 14. The engaging piece 16 is formed at the center of the top plate 14*b*. The engaging piece 16 has an engaging projection 16*a* which is formed at the top end of the engaging piece 16 inwardly from the coupling edge of the top plate 14*b*. A forward end portion 14*d* is formed on the top plate 14*b* within a predetermined space between the top end of the engaging projection 16' and the coupling edge of the top plate 14*b*. On the top surface of the housing 17 of the socket connector 11, an engaging groove 27' is formed to engage the engaging projection 16*a'* upon the complete coupling.

In this embodiment also, when the socket connector 11 is inserted into the pin connector 10 for connection, the engaging projection 16*a'* at the top end of the engaging piece 16 is brought in a press contact with the top surface of the housing 17 to bend the engaging piece 16 upwards. The engaging projection 16*a'* at the top of the engaging piece 16 is brought into contact with the opening edge 28 of the movable cover 20. With the progress of the insertion, the movable cover 20 moves backwardly against the urging force of the springs 24. Subsequently, when the engaging projection 16*a'* is engaged with the engaging groove 27', the engaging piece 16 is recovered from a bending state into an original or straight shape. When the engaging piece 16 is recovered into the original shape, the movable cover 20 is urged by the springs 24 to be pushed back until the engaging piece 16 and the top plate 14*b* of the housing 14 are covered by the movable cover 20. The opening edge 28 of the movable cover 20 is brought into contact with the step portion 14*e* of the housing 14. Thus, the movable cover 20 is stably held in position.

In the connector according to this embodiment, the opening edge 28 is brought into contact with the step portion 14*e* before the projections 26 engages or collides with the edges of the elongated holes 25 formed on the movable cover 20. With this structure, it is possible to reduce the load applied upon the projections 26, as compared with the corresponding load in the first embodiment.

In the above-mentioned embodiment, the engaging piece 16 including the engaging projection 16*a'* is formed on the top plate 14*b* alone. However, the engaging piece 16 may be formed on the bottom plate 14*c* instead of the top plate 14*b*. Alternatively, the engaging pieces 16 may be formed both on the top and the bottom plates 14*b* and 14*c*. Although only one is provided in this embodiment, an appropriate number of the engaging pieces 16 may be formed on demand.

What is claimed is:

1. A connector comprising a first connection member, a second connection member adapted to make a predetermined connection with said first connection member responsive to motion in a predetermined direction, and mechanical coupling means for mechanically coupling said first connection member with said second connection member in said predetermined direction, said first connection member having a principal surface which is extended in said predetermined direction, wherein said mechanical coupling means comprises:

a first engaging portion connected to said principal surface of the first connection member;

a flexible arm integrally formed of the same material and extending from a side wall of said second connection member and extending in parallel to said principal surface in said predetermined direction when said first connection member is connected to said second connection member, said flexible arm being flexible in a particular plane perpendicular to said principal surface;

a second engaging portion connected to said flexible arm for being brought into engagement with said first engaging portion when said predetermined connection is obtained, said second engaging portion being disengaged from said first engaging portion with said flexible arm bent in said particular plane; a movable member coupled to said first connection member and movable between a first and a second position in said predetermined direction, said movable member allowing said bending of the flexible arm when said movable member is located at said first position, said movable member preventing said bending of the flexible arm when said movable member is located at said second position;

urging means connected to said first connection member and said movable member for urging said movable member towards said second position; and disengagement inhibiting means coupled to said first and said second connection members for detecting whether or not said second engaging portion is engaged with said first engaging portion, said disengagement inhibiting means automatically preventing said flexible arm from bending in said particular plane when said second engaging portion is engaged with said first engaging portion and said disengagement means surrounds said second engaging portion.

2. A connector as claimed in claim 1, wherein said disengagement inhibiting means comprises:

displacement means connected to said second connection member for engaging said movable member in order to move said movable member to said first position when said first and said second connection members are relatively moved in said predetermined direction to make said predetermined connection;

disengagement means connected to at least one of said first and said second engaging portions and to said movable member for detecting whether or not said second engaging portion is engaged with said first engaging portion, said disengagement means disengaging said displacement means from said movable member when said predetermined engagement is obtained and said second engaging portion is engaged with said first engaging portion.

3. A connector as claimed in claim 2, further comprising stopper means connected to said first connection member and said movable member for stopping said movable member at said second position against said urging means.

4. A connector as claimed in claim 2, further comprising stopper means connected to said second connection member and said movable member for stopping said movable member at said second position against said urging means.

5. A connector as claimed in claim 2, wherein said first engaging portion comprises a recessed portion formed on said principal surface of the first connection member, said second engaging portion comprising a projection formed on said flexible arm, said projection being fitted into said recessed portion to engage said second engaging portion with said first engaging portion when said predetermined connection is obtained.

6. A connector as claimed in claim 5, wherein said movable member faces said principal surface of the first connection member with a predetermined space left therebetween when said movable member is at said second position, said predetermined space having a first width in a particular direction perpendicular to said principal surface of the first connection member, said flexible arm having a second width which is smaller than said first width in said particular direction, said projection having a third width in said particular direction, said first width being smaller than a sum of said second and said third widths.

7. A connector comprising:

a first and a second connection member adapted to be coupled and connected with each other in a coupling direction, a flexible arm integrally formed of the same material and extending from a side wall of said second connection member in said coupling direction, an engaging projection projecting from said flexible arm in a direction perpendicular to said coupling direction, a movable member coupled to said first connection member and movable in said coupling direction, a spring connected to said first connection and said movable members for urging said movable member in said coupling direction, and an engaging groove formed at an outer periphery of said first connection member for being brought into engagement with said engaging projection when said first and said second connection members are put into a complete coupling and connection, said movable member being provided with an opening portion for receiving said flexible arm when said engaging projection is engaged with said engaging groove, said engaging projection being brought into a press contact with the outer periphery of said first connection member in the course of a coupling operation while a top end of said flexible arm is brought into a contact with an opening edge of said movable member, so that said second connection member is urged through said movable member by said spring to be separated from said first connection member in said coupling direction.

8. A connector as claimed in claim 7, wherein said spring has an urging force greater than a removal force between said first and said second connection members.

* * * * *